US007519304B2

(12) United States Patent
Namba

(10) Patent No.: US 7,519,304 B2
(45) Date of Patent: Apr. 14, 2009

(54) IMAGE FORMING MEANS WITH MARK REMOVING UNIT

(75) Inventor: Hideyuki Namba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 393 days.

(21) Appl. No.: 11/354,010

(22) Filed: Feb. 15, 2006

(65) Prior Publication Data

US 2007/0059053 A1 Mar. 15, 2007

(30) Foreign Application Priority Data

Sep. 15, 2005 (JP) ..... P2005-269022

(51) Int. Cl.
*G03G 15/00* (2006.01)

(52) U.S. Cl. ..... 399/49; 399/99; 399/375

(58) Field of Classification Search ..... 399/49, 399/375, 99
See application file for complete search history.

(56) References Cited

U.S. PATENT DOCUMENTS 5,722,012 A * 2/1998 Saitoh ..... 399/99

FOREIGN PATENT DOCUMENTS

JP A-2001-142280 5/2001

* cited by examiner

*Primary Examiner*—David M Gray
*Assistant Examiner*—Bryan Ready
(74) *Attorney, Agent, or Firm*—Morgan, Lewis & Bockius LLP

(57) ABSTRACT

An image forming apparatus includes a plurality of image forming parts that form toner images having colors different from each other, the plurality of image forming parts disposed in series to multiply-transfer the toner images of the colors directly to a recording medium to form a color image; a detecting unit that detects a mark on the recording medium formed by the plurality of image forming parts; a print controlling part that controls image forming positions of the plurality of image forming parts based on a detection result of the mark by the detecting unit; and a mark removing unit that removes the mark formed on the recording medium before fixing.

5 Claims, 7 Drawing Sheets

PRIOR ART

PRIOR ART

IMAGE FORMING MEANS WITH MARK REMOVING UNIT

BACKGROUND OF THE INVENTION

1. Field of the Invention

The present invention relates to an image forming apparatus using an electrophotography system, such as a color printer, and in particular, an image forming apparatus, such as an ultrahigh-speed continuous paper color printer capable of forming a full color image on continuous paper as a recording medium at an ultrahigh speed.

2. Description of the Related Art

Such a printer has been known as the printer of this kind that toner images of colors including yellow (Y), magenta (M), cyan (C) and black (K) are multiply transferred directly to paper from photoreceptor drums forming the toner images to form a full color image without an intermediate transfer medium used. In the printer, the toner images of the colors are transferred from the photoreceptor drums directly to paper without an intermediate transfer medium used, whereby the running cost due to consumption of the intermediate transfer medium is prevented from being increased.

For example, as shown in FIG. 7, an ultrahigh-speed continuous paper color printer 100 has image forming parts 101Y, 101M, 101C and 101K corresponding to colors of yellow (Y), magenta (M), cyan (C) and black (K), respectively, arranged in series, in which toner images formed with photoreceptor drums 102 of the image forming parts 101Y, 101M, 101C and 101K are multiply transferred directly to continuous paper 103 fed at an ultrahigh speed, and then fixed with a fixing part 104 employing a flash fixing system, so as to form a full color image.

In the ultrahigh-speed continuous paper color printer, a mark 105 for detecting color registration is formed on a part of the paper 103 for precisely controlling the positions of the images (registration) formed with the image forming parts 101Y, 101M, 101C and 101K corresponding to colors of yellow (Y), magenta (M), cyan (C) and black (K), respectively, and the mark 105 for detecting color registration is detected with a color registration sensor 106 to calculate registration deviation amounts of the images of respective colors, which are fed back to the paper feed amount and the drawing positions in main scanning direction and subscanning direction in the image forming parts 1O1Y, 101M, 1O1C and 101K.

However, the aforementioned conventional technique includes the following problems. In the conventional ultrahigh-speed continuous paper color printer as shown in FIG. 8, it is necessary that a mark 105 for detecting color registration is formed on a part of paper 103 for precisely controlling the color registration, and therefore, the mark 105 for detecting color registration remains on the paper 104.

Accordingly, it is necessary in the conventional ultrahigh-speed continuous paper color printer that the mark 105 for detecting color registration is cut out in the final stage, or in alternative, a user is asked to tolerate the mark 105 for detecting color registration remaining on the paper 103. Therefore, there is such a problem that the constitution of the printer becomes complicated, or the disadvantage of the mark 105 for detecting color registration remaining on the paper 104 is rendered to a user.

As a technique for providing a color image with high quality by preventing color registration deviation, JP-A-2001-142280 proposes an image forming apparatus. However, the image forming apparatus proposed in JP-A-2001-142280 has a transfer medium including an intermediate transfer belt and a cleaning unit for cleaning the transfer medium, and thus the configuration, on which the apparatus is based, is different from the invention.

SUMMARY OF THE INVENTION

The invention has been made in view of the above circumstances and provides an image forming apparatus.

According to an embodiment of the present invention, an image forming apparatus includes; a plurality of image forming parts that form toner images having colors different from each other, the plurality of image forming parts disposed in series to multiply-transfer the toner images of the colors directly to a recording medium to form a color image; a detecting unit that detects a mark on the recording medium formed by the plurality of image forming parts; a print controlling part that controls image forming positions of the plurality of image forming parts based on a detection result of the mark by the detecting unit; and a mark removing unit that removes the mark formed on the recording medium before fixing.

BRIEF DESCRIPTION OF THE DRAWINGS

Embodiment may be described in detail with reference to the accompanying drawings, in which.

DETAILED DESCRIPTION OF THE INVENTION

Embodiments of the invention will be described below with reference to the drawings.

Embodiment 1

Figure 1:
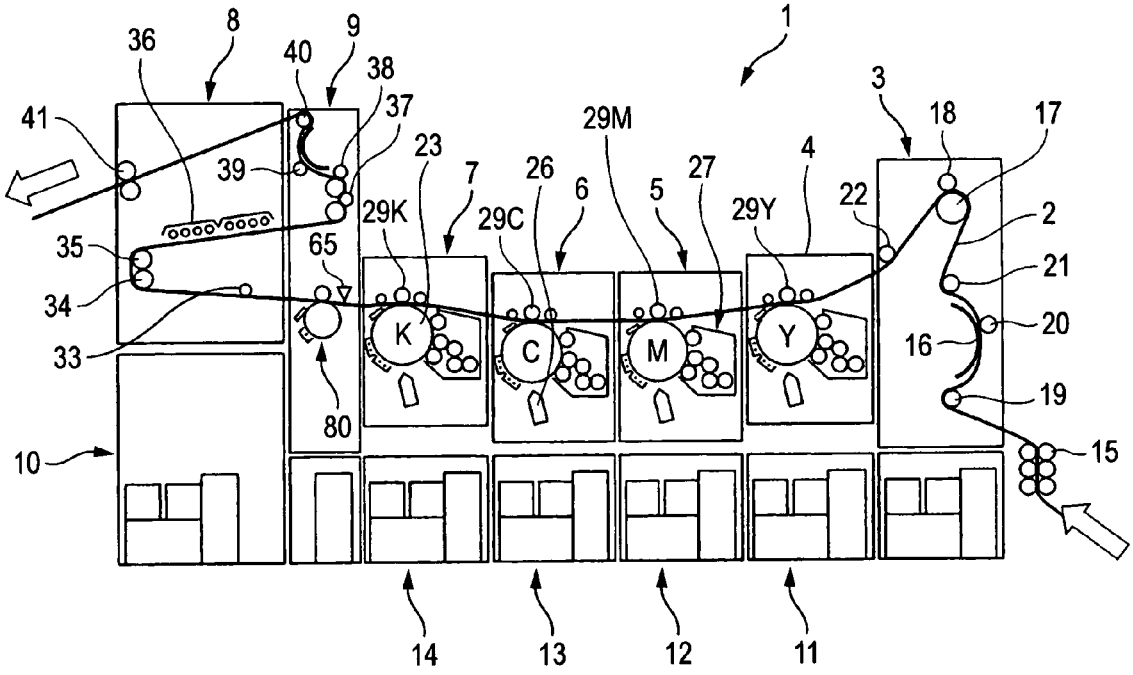
FIG. 1 is a constitutional view showing an ultrahigh-speed continuous paper color printer as Embodiment 1 of the image forming apparatus of the invention.

FIG. 1 is a schematic constitutional view showing a tandem ultrahigh-speed continuous paper color printer as Embodiment 1 of the image forming apparatus of the invention.

As shown in FIG. 1, the tandem ultrahigh-speed continuous paper color printer 1 basically has a paper feeding part 3 for feeding continuous paper 2 as a recording medium, a first image forming part 4 for forming an image of yellow (Y) color, a second image forming part 5 for forming an image of magenta (M) color, a third image forming part 6 for forming an image of cyan (C) color, a fourth image forming part 7 for forming an image of a black (K) color, a fixing part 8 for fixing the toner images of yellow (Y), magenta (M), cyan (C) and black (K) colors to the continuous paper 2, on which the toner images have been multiply transferred, a tension controlling part 9 for controlling the tension of the continuous paper 2, a main print controlling part 10 having controllers, and subsidiary controlling parts 11 to 14 corresponding to the image forming parts 4 to 7 of the respective colors, respectively.

The paper feeding part 3 has a delivery reference roller 17 and a driven roller 18 for feeding the continuous paper 2, which is fed from a paper feeding part (not shown in the figure) with triple paper feeding rollers 15, through a curved delivery path 16 by holding with a pair of rollers, and plural guide rollers 19 to 22 for guiding the continuous paper 2. The continuous paper 2 herein is paper as a recording medium, which has a long continuous form with fold lines (perforated lines) per one page.

The first to fourth image forming part 4 to 7 of yellow (Y), magenta (M), cyan (C) and black (K) colors have the same constitution except for color of an image to be formed, and therefore, the first image forming part 4 for forming an image of yellow (Y) color is described herein as a representative example.

Figure 2:
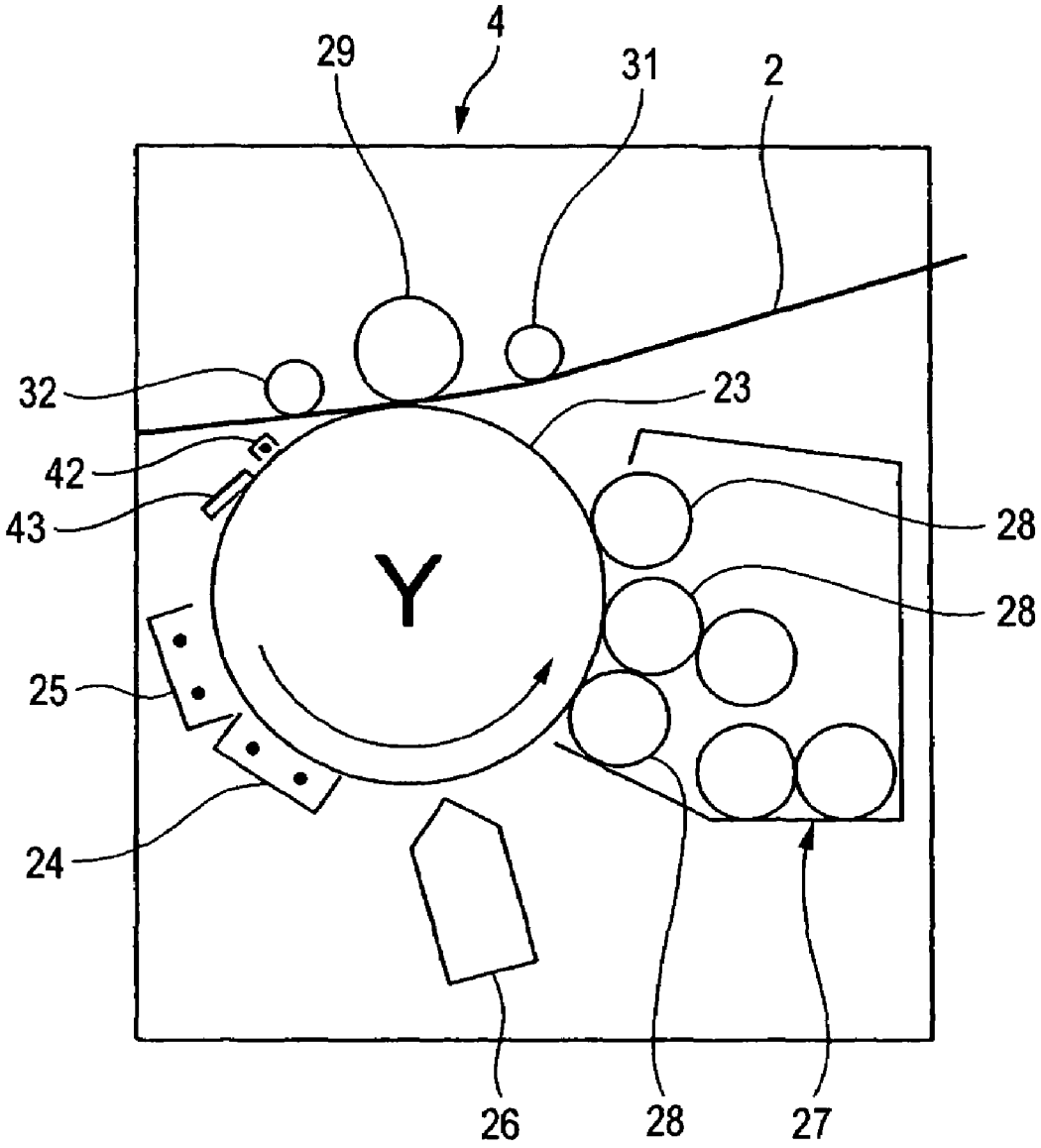
FIG. 2 is a constitutional view showing an image forming part of the ultrahigh-speed continuous paper color printer as Embodiment 1 of the image forming apparatus of the invention.

As shown in FIG. 2, the first image forming part 4 has disposed therein a photoreceptor drum 23 as an image carrying member capable of rotating in the direction shown by the arrow at a high speed. The photoreceptor drum 23 has a large diameter of about 260 mm and is constituted by an electroconductive cylindrical member formed of aluminum or stainless steel having coated thereon a photoreceptor layer formed of a photoconductor material, such as OPC, amorphous Si and Se. Two primary charging devices 24 and 25 for uniformly charging the surface of the photoreceptor drum 23 to a prescribed potential, such as a scorotron, are disposed on the obliquely lower left side of the photoreceptor drum 23. An LED printer head 26 having an LED array as an imagewise exposing unit for imagewise exposing the surface of the photoreceptor drum 23, which has been uniformly charged to a prescribed potential with the tandem primary charging devices 24 and 25, corresponding to image information is disposed on the lower side of the photoreceptor drum 23. The surface of the photoreceptor drum 23 is imagewise exposed with the LED printer head 26 to form an electrostatic latent image thereon corresponding to image information.

As the photoreceptor drum 23, one having a long size is used for printing on not only 18-inch width paper but also 24-inch width paper, and the primary charging devices 24 and 25, the LED printer head 26 and a developing device 27 described later are also those having a long size corresponding to the photoreceptor drum 23. The paper is fed with one edge of the photoreceptor drum 23 along the axis thereof as the reference, but the invention is not limited thereto, and the paper may be fed with a center in the axis direction of the photoreceptor drum 23 as the reference.

The electrostatic latent image formed on the surface of the photoreceptor drum 23 is visualized with a developing device 27 disposed on the right side of the photoreceptor drum 23 to form a toner image formed of a powder toner. The developing device 27 has triple developing rolls 28 disposed therein for developing the electrostatic latent image formed on the photoreceptor drum 23 at a high speed corresponding to the high rotation speed of the photoreceptor drum 23. The developing device 27 may employ either the one-component developing system or the two-component developing system.

A transferring roll 29 as a transferring member for transferring the toner image formed on the photoreceptor drum to the continuous paper 2 as a recording medium is disposed on an upper side of the photoreceptor drum 23, and the toner image formed on the photoreceptor drum 23 is transferred onto the continuous paper 2 through charging with the transferring roll 29. Rolls 31 and 32 for stretching the continuous paper 2 are disposed on both the upstream side and the downstream side of the transferring roll 29.

The continuous paper 2 as a recording medium is fed from the paper feeding part (not shown in the figure). The continuous paper 2 has a long continuous form with fold lines (perforated lines) per one page, and a set of the folded continuous paper 2 (not shown in the figure) is disposed in the paper feeding part.

As the continuous paper 2, various kinds of paper having various sizes and kinds are used depending on needs of the user, and seven or eight kinds or more kinds of paper are accommodated, such as ordinary paper, paper thinner than ordinary paper, heavy paper, coated paper obtained coating the surface of ordinary paper or heavy paper, and paper colored to a prescribed color, such as yellow. The continuous paper 2 may be 18-inch width paper or paper having a larger width, such as 24-inch width paper, as having been described.

The continuous paper 2 having a yellow toner image transferred thereon from the photoreceptor drum 23 for yellow color with the transferring roll 29 is sequentially fed to the image forming parts 5 to 7 on the downstream side as shown in FIG. 1, whereby toner images of magenta (M), cyan (C) and black (K) colors are multiply transferred thereon. Thereafter, the continuous paper 2 is fed to the fixing part 8 with feeding rollers 33, 34 and 35, and the unfixed toner images are fixed on the continuous paper 2 with a flash fixing device 36 disposed in the fixing part 8. The continuous paper 2 is then delivered in a folded state to a paper delivering tray provided in a paper delivery part (not shown in the figure) with feeding rollers 41 through rollers 38, 39 and 40 in a state where the tension thereof is adjusted with a tension controlling mechanism 37 of a tension controlling part 9.

On the surface of the photoreceptor drum 23 having been subjected to the transferring step of the toner image completed, as shown in FIG. 2, residual charge is destaticized with a destaticizing device 42 containing a corotron, and paper powder and toner powder remaining thereon are removed with a cleaning blade 43, so as to prepare for the next image forming step.

Figure 3:
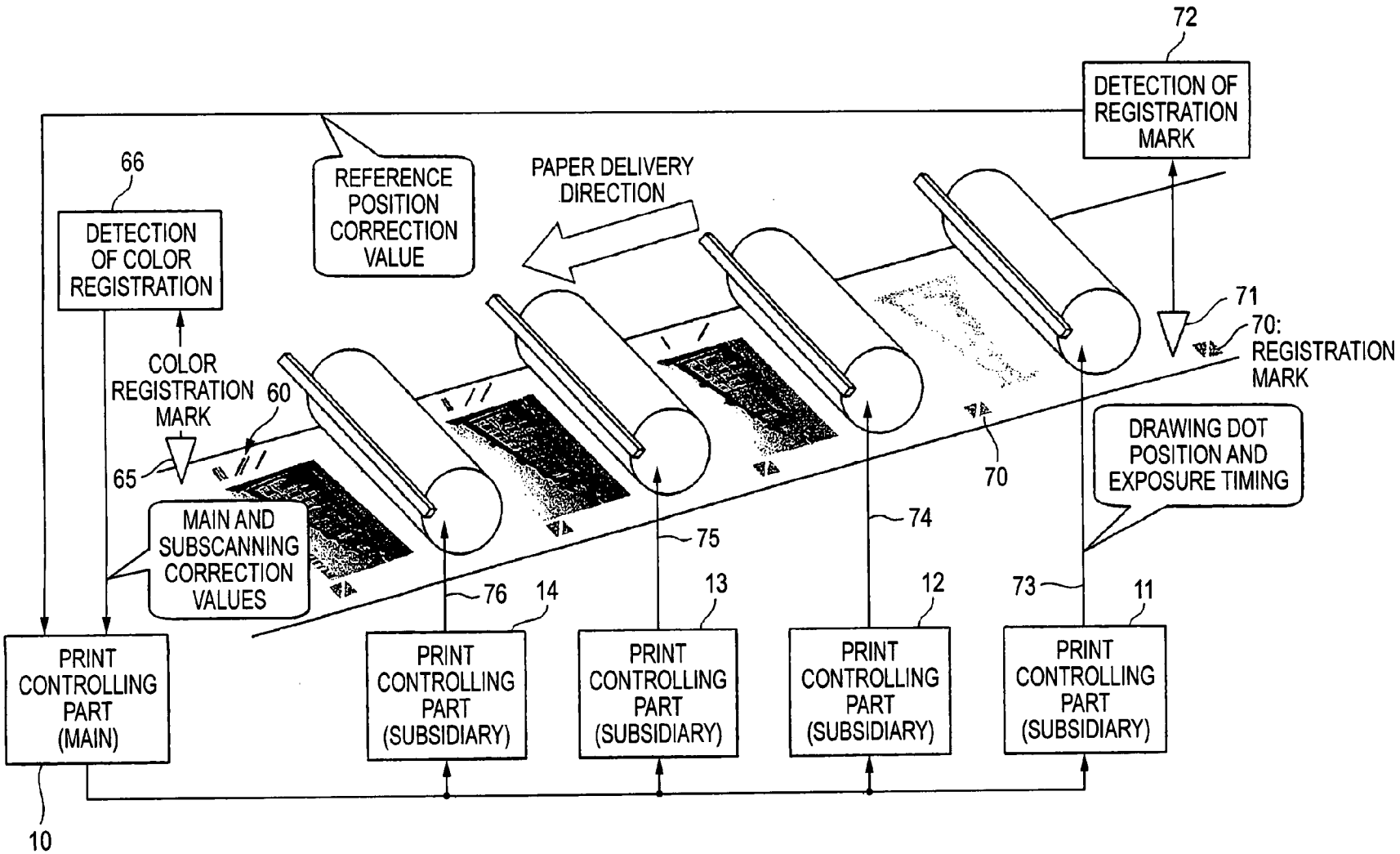
FIG. 3 is a perspective constitutional view showing an image, a mark for detecting color registration and the like formed by the ultrahigh-speed continuous paper color printer as Embodiment 1 of the image forming apparatus of the invention.
Figure 4:
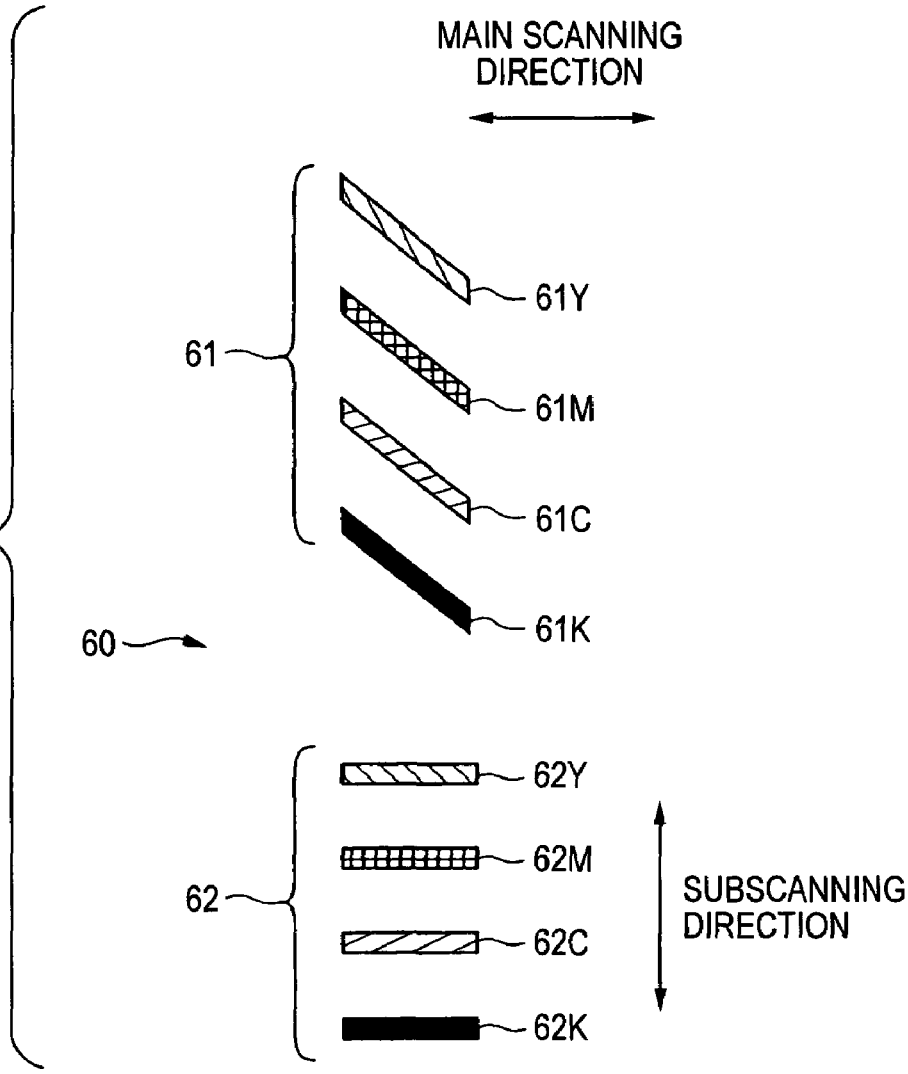
FIG. 4 is an explanatory view showing a mark for detecting color registration.

In the ultrahigh-speed continuous paper color printer 1, as shown in FIG. 3, a mark 60 for detecting color registration is forme don one edge part in the width direction of the continuous paper 2 for controlling color registration of the toner images formed by the image forming parts 4 to 7 of yellow (Y), magenta (M), cyan (C) and black (K) colors. The mark 60 for detecting color registration may contain, for example, a first mark 61, which is for detecting mainly registration deviation in the main scanning direction, and a second mark 62, which is for detecting mainly registration deviation in the subscanning direction, as shown in FIG. 4. The first mark 61 is formed, for example, in a linear form slanted by 45° to the main scanning direction, and the second mark 62 is formed, for example, in a linear form in parallel to the main scanning direction. The mark 60 for detecting color registration is not limited to the aforementioned form and may be any arbitrary form without limitation.

A registration sensor 65 as a detecting unit for detecting the mark 60 for detecting color registration is disposed on the downstream side of the fourth image forming part 7 as shown in FIGS. 1 and 3. The registration sensor 65 may, for example, emit light to the mark 60 for detecting color registration and receive light reflected by the mark 60 for detecting color registration with a light receiving device, so as to detect the position of the mark 60 for detecting color registration.

The continuous paper 2 has a registration mark 70 for detecting the reference position for forming an image provided in advance on another edge opposite to the mark 60 for detecting color registration, and the registration mark 70 is detected with a registration mark sensor 71 disposed on the upstream side of the first image forming part 4.

In the ultrahigh-speed continuous paper color printer 1, as shown in FIG. 3, a detection signal 66 from the registration sensor 65 for detecting color registration and a registration mark detection signal 72 from the registration mark sensor 71 are input in the main print controlling part 10. The main print controlling part 10 sends control signals 73 to 76 to the subsidiary controlling parts 11 to 14 corresponding to the image forming parts 4 to 7 of the respective colors, respectively, for controlling the image forming positions in the image forming parts 4 to 7 based on the signals 66 and 72 from the registration sensor 65 for detecting color registration and the registration mark sensor 71. The subsidiary controlling parts 11 to 14 control the drawing position and the exposure timing of image wise exposure with the LED printer head 26 in the respective image forming parts to control the image forming positions therein.

In this embodiment, the image forming apparatus contains plural image forming parts forming toner images having colors different from each other disposed in series, in which toner images of the colors formed by the plural image forming parts are multiply transferred directly to a recording medium to form a color image, and a mark fox detecting an image position is formed at apart of the recording medium to control image forming positions of the plural image forming parts based on detection results of the mark for detecting an image position with a detecting unit, and the image forming apparatus further contains a mark removing unit removing the mark for detecting an image position formed on the recording medium before fixing.

In this embodiment, the mark removing unit contains an image carrying member for carrying the mark for detecting an image position transferred from the recording medium, and a transferring unit for transferring the mark for detecting an image position from the recording medium to the image carrying member.

In this embodiment, the image carrying member is disposed only at a position corresponding to the position of the recording medium where the mark for detecting an image position is formed.

In this embodiment, the mark removing unit is operated only at a position corresponding to a position of the recording medium where the mark for detecting an image position is formed.

That is, as shown in FIG. 1, the ultrahigh-speed continuous paper color printer 1 according to the embodiment has a mark removing unit 80 removing the mark for detecting an image position, which has been formed with the first to fourth image forming parts 4 to 7, before fixing.

Figure 5:
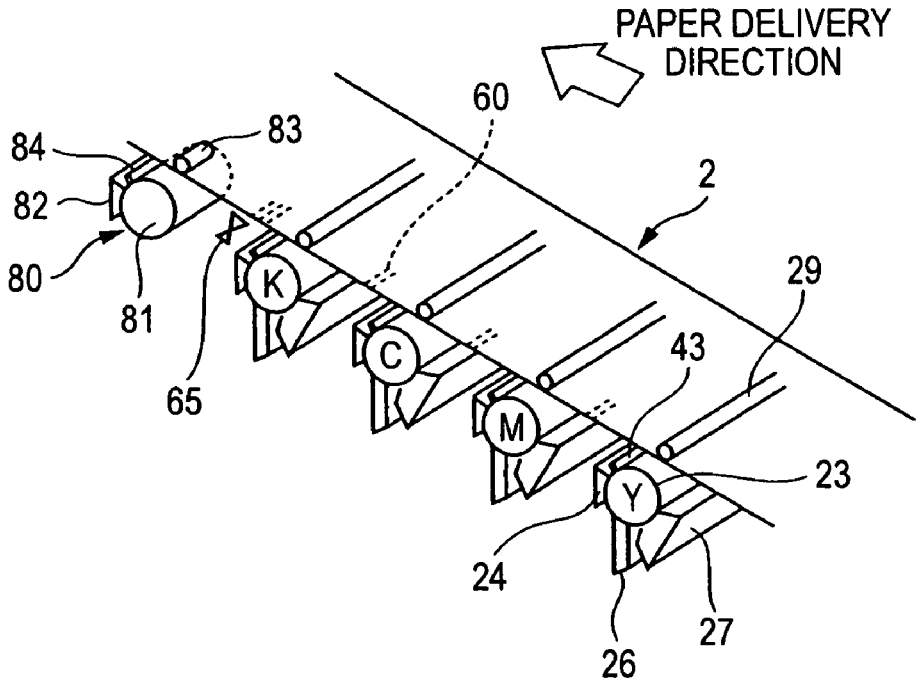
FIG. 5 is a perspective constitutional view showing an important part of the ultrahigh-speed continuous paper color printer as Embodiment 1 of the image forming apparatus of the invention.
Figure 6:
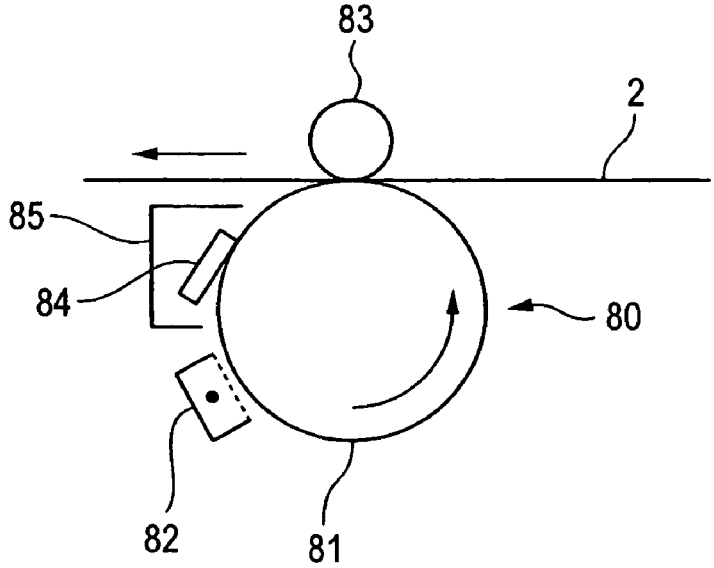
FIG. 6 is a constitutional view showing an important part of the ultrahigh-speed continuous paper color printer as Embodiment 1 of the image forming apparatus of the invention.
Figure 7:
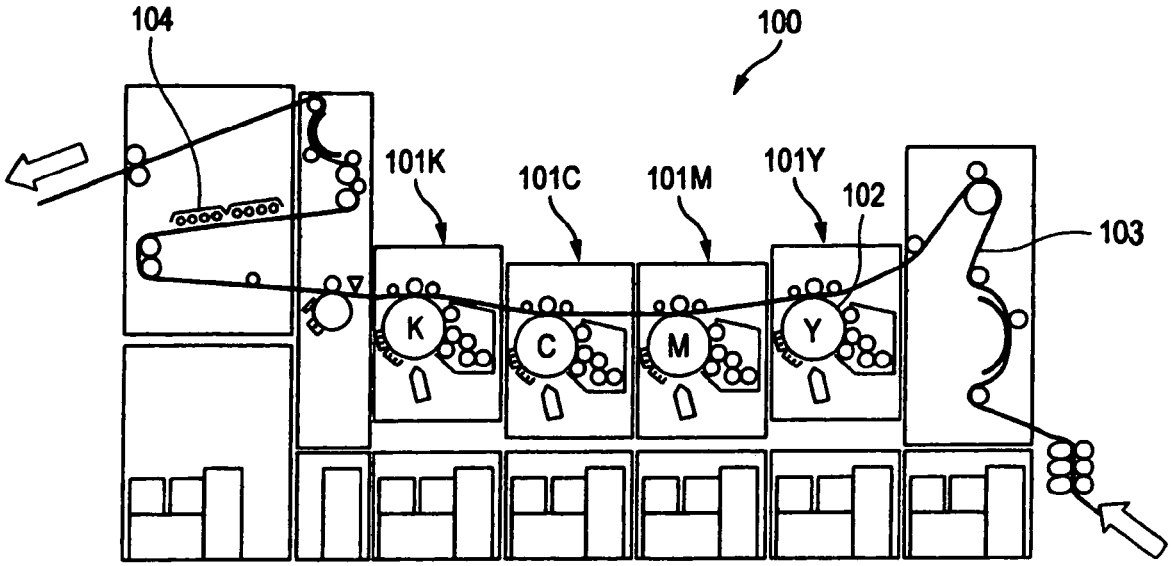
FIG. 7 is a constitutional view showing an important part of a conventional ultrahigh-speed continuous paper color printer.
Figure 8:
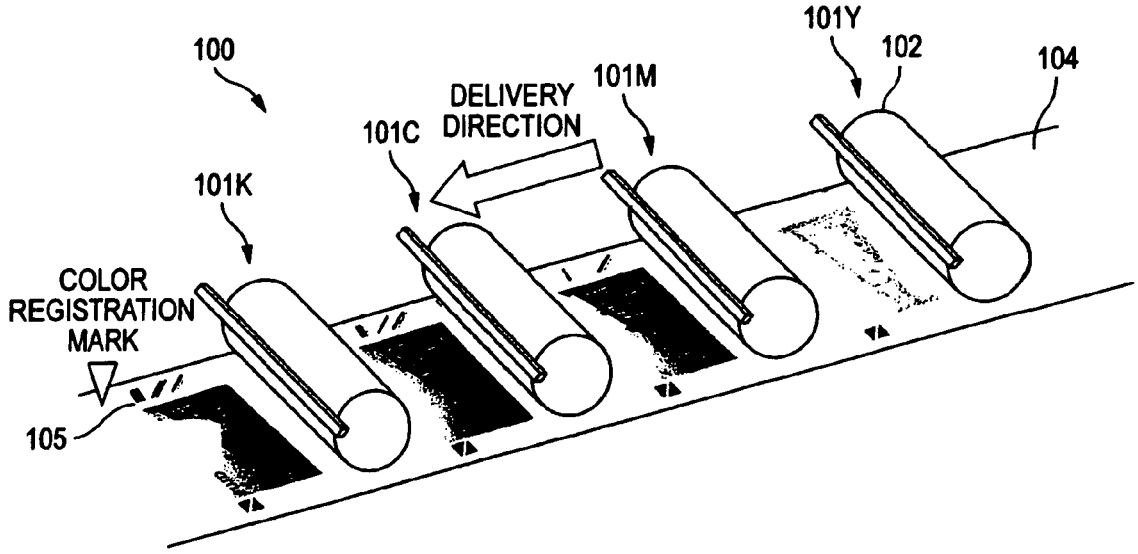
FIG. 8 is a perspective constitutional view showing an image, a mark for detecting color registration and the like formed by a conventional ultrahigh-speed continuous paper color printer.

The mark removing unit 80 is disposed on the downstream side of the fourth image forming part 7, and in this embodiment, disposed in the tension controlling part 9 as shown in FIG. 1. As shown in FIGS. 1, 5 and 6, the mark removing unit 80 has a photoreceptor drum 81 as an image carrying member, a charging device 82, such as a scorotron or a charging roll, for charging the surface of the photoreceptor drum 81 to a prescribed potential, a transferring roll 83 for transferring the mark 60 for detecting color registration from the continuous paper 2 to the photoreceptor drum 81, and a cleaning device 85 having a cleaning blade 84 for removing the toner constituting the mark 60 for detecting color registration thus transferred onto the surface of the photoreceptor drum 81.

An electroconductive cylindrical member of the photoreceptor drum 81 is grounded and maintained at 0 V.

The photoreceptor drum 81 and the like constituting the mark removing unit 80 may be formed over the entire width of the continuous paper 2, but since the mark 60 for detecting color registration is provided only on one edge part in the width direction of the continuous paper 2, it is sufficient that the photoreceptor drum 81 and the like constituting the mark removing unit 80 is provided only on one edge part in the width direction of the continuous paper 2.

In this embodiment, the mark removing unit 80 containing the photoreceptor drum 81 and the like is provided only on one edge part in the width direction of the continuous paper 2 corresponding to the position of the mark 60 for detecting color registration.

According to the aforementioned constitution, in the tandem ultrahigh-speed continuous paper color printer of the embodiment, which forms a full color image by transferring toner images directly to a recording medium, such as continuous paper, by using no intermediate transfer material, not only color registration deviation can be prevented from occurring, but also a mark for detecting color registration can be prevented from remaining on a recording medium, such as paper, in the following manner.

That is, in the ultrahigh-speed continuous paper color printer 1 of the embodiment, as shown in FIG. 1, toner images of yellow (Y), magenta (M), cyan (C) and black (K) colors are sequentially formed with the first to fourth image forming parts 4 to 7, and the toner images of yellow (Y), magenta (M), cyan (C) and black (K) colors sequentially formed with the first to fourth image forming parts 4 to 7 are transferred directly on the continuous paper 2 in a multiply overlapped state with the transfer rolls 29 of the respective image forming parts.

Thereafter, the toner images of yellow (Y), magenta (M), cyan (C) and black (K) colors thus multiply transferred to the continuous paper 2 are fixed thereon with the flash fixing device 36 of the fixing part 8 to form a permanent image.

In the ultrahigh-speed continuous paper color printer 1 of the embodiment, as shown in FIG. 1, the toner images of yellow (Y), magenta (M), cyan (C) and black (K) colors are transferred directly to the continuous paper 2 with the first to fourth image forming parts 4 to 7 to form a full color image, and therefore, deviation in image forming position and image forming timing among the first to fourth image forming parts 4 to 7 comes up as deviation in color registration, which causes deterioration in image quality, such as color drift.

In the aforementioned ultrahigh-speed continuous paper color printer 1, in particular, images are sequentially formed on the continuous paper at a high speed, deviation in image forming position and image forming timing among the first to fourth image forming parts 4 to 7 brings about a large number of images suffering deterioration in image quality, such as color drift.

Under the circumstances, in the ultrahigh-speed continuous paper color printer 1, a mark 60 for detecting color registration is formed at a prescribed timing on a position along one edge in the width direction of the continuous paper 2 as shown in FIG. 3, and the mark 60 for detecting color registration is detected with a sensor 65 for detecting color registration to control the image forming position and the image forming timing among the first to fourth image forming parts 4 to 7, particularly the image forming parts other than that used as the reference, with the main print controlling part 10 and the subsidiary controlling parts 11 to 14, whereby deviation in color registration is prevented or suppressed from occurring.

However, the mark 60 for detecting color registration formed on the position along one edge in the width direction of the continuous paper 2 remains on the continuous paper 2 if the mark 60 is not removed.

In this embodiment as shown in FIG. 1, accordingly, the mark 60 for detecting color registration formed on the continuous paper 2 is removed with the mark removing unit 80 after detecting the mark 60 with the sensor 65 for detecting color registration. The mark removing unit 80 may not completely remove the mark 60 for detecting color registration, but it is sufficient that the mark removing unit 80 reduces the density of the mark 60 for detecting color registration to such an unobtrusive level that causes no problem.

As shown in FIG. 6, in the mark removing unit 80, the surface of the photoreceptor drum 81 is charged to a prescribed potential with the charging device 82 as synchronized with the position of the mark 60 for detecting color registration. The charging potential of the surface of the photoreceptor drum 81 is provided for facilitating transfer of the mark 60 for detecting color registration from the continuous paper 2 onto the surface of the photoreceptor drum 81.

The mark 60 for detecting color registration is generally formed with a toner having negative charging polarity, and therefore, the surface potential of the photoreceptor drum 81 is set at such a potential that is lower than the potential of the toner having negative charging polarity, e.g., a potential near 0 V (about from −100 V to +100 V), for facilitating transfer of the toner having negative charging polarity.

The photoreceptor drum 81 is rotationally driven at the same velocity as the moving velocity of the continuous paper 2, and upon moving the surface of the photoreceptor drum 81 to the transferring position, the mark 60 for detecting color registration is electrostatically transferred to the surface of the photoreceptor drum 81 with a transferring electric field applied with the transferring roll 83. In this stage, the transferring roll 83 is applied with a negative transferring voltage, for example, of about −1,000 V.

The mark 60 for detecting color registration thus transferred onto the photoreceptor drum 81 is then removed with the cleaning blade 84 of the cleaning device 85 to prepare for the next removal step. The surface of the photoreceptor drum 81 may be subjected to destaticizing with a destaticizer or exposure for destaticizing with a destaticizing lamp, prior to the cleaning step with the cleaning device 85.

As having been described, in the ultrahigh-speed continuous paper color printer 1 according to the embodiment, the mark 60 for detecting color registration formed on the continuous paper 2 is removed or reduced in density with the mark removing unit 80 after detection but before fixing. Accordingly, in an image forming apparatus forming a full color image by transferring toner images directly to a recording medium, such as the continuous paper 2, not only color registration deviation can be prevented from occurring, but also the mark 60 for detecting color registration can be prevented from remaining on the continuous paper 2.

Consequently, in the aforementioned ultrahigh-speed continuous paper color printer, it is not necessary to cut out the mark 60 for detecting color registration in the final stage, or to ask a user to tolerate the mark 60 for detecting color registration remaining on paper, whereby such an excellent printer can be provided that forms an image with high quality, requires no device for cutting out the mark 60 for detecting color registration, prevents the constitution thereof from being complicated, and renders no disadvantage to a user.

As described above, according to an embodiment of the invention, an image forming apparatus comprises: a plurality of image forming parts that form toner images having colors different from each other, the plurality of image forming parts disposed in series to multiply-transfer the toner images of the colors directly to a recording medium to form a color image; a detecting unit that detects a mark on the recording medium formed by the plurality of image forming parts; a print controlling part that controls image forming positions of the plurality of image forming parts based on a detection result of the mark by the detecting unit; and a mark removing unit that removes the mark formed on the recording medium before fixing.

According to another aspect of the invention, the mark removing unit includes an image carrying member that carries the mark transferred from the recording medium, and a transferring unit that transfers the mark from the recording medium to the image carrying member.

According to another aspect of the invention, the image carrying member is disposed at a position corresponding to a position of the recording medium where the mark is formed.

According to another aspect of the invention, the mark removing unit is operated at a position corresponding to a position of the recording medium where the mark is formed.

According to another aspect of the invention, the mark removing unit reduces a density of the mark a predetermined level.

According to the aspects of the invention, such an image forming apparatus, which forms a full color image by transferring toner images directly to a recording medium, such as continuous paper, by using no intermediate transfer material, may be provided in that not only color registration deviation may be prevented from occurring, but also a mark for detecting color registration may be prevented from remaining on a recording medium, such as paper.

The entire disclosure of Japanese Patent Application No. 2005-269022 filed on Sep. 15, 2005 including specification, claims, drawings and abstract is incorporated herein by reference in its entirety.

What is claimed is:

1. An image forming apparatus, comprising:

a plurality of image forming parts that form toner images having colors different from each other, the plurality of image forming parts disposed in series to multiply-transfer the toner images of the colors directly to a recording medium to form a color image;

a detecting unit that detects a mark on the recording medium formed by the plurality of image forming parts;

a print controlling part that controls image forming positions of the plurality of image forming parts based on a detection result of the mark by the detecting unit; and a mark removing unit that removes the mark formed on the recording medium before fixing.

2. The image forming apparatus as claimed in claim 1, wherein the mark removing unit includes an image carrying member that carries the mark transferred from the recording medium, and a transferring unit that transfers the mark from the recording medium to the image carrying member.

3. The image forming apparatus as claimed in claim 2, wherein the image carrying member is disposed at a position corresponding to a position of the recording medium where the mark is formed.

4. The image forming apparatus as claimed in claim 1, wherein the mark removing unit is operated at a position corresponding to a position of the recording medium where the mark is formed.

5. The image forming apparatus as claimed in claim 1, wherein the mark removing unit reduces a density of the mark to a predetermined level.

* * * * *